US012593911B2

(12) United States Patent
Clinard et al.

(10) Patent No.: US 12,593,911 B2
(45) Date of Patent: Apr. 7, 2026

(54) WORKBENCH WITH ADJUSTABLE FOOT ASSEMBLY

(71) Applicant: Kindred Products LLC, Benton Harbor, MI (US)

(72) Inventors: Sarah J. Clinard, Rolling Prairie, IN (US); Heidi Hurst, Saint Joseph, MI (US); Clayton Olsen, Portland, MI (US); Curtis Taylor, Benton Harbor, MI (US)

(73) Assignee: Kindred Prodcuts LLC, Benton Harbor, MI (US)

( * ) Notice: Subject to any disclaimer, the term of this patent is extended or adjusted under 35 U.S.C. 154(b) by 80 days.

(21) Appl. No.: 18/603,930

(22) Filed: Mar. 13, 2024

(65) Prior Publication Data

US 2025/0288093 A1 Sep. 18, 2025

(51) Int. Cl.
*A47B 9/04* (2006.01)
*A47B 9/20* (2006.01)

(52) U.S. Cl.
CPC . *A47B 9/04* (2013.01); *A47B 9/20* (2013.01)

(58) Field of Classification Search
CPC ..... A47B 9/04; A47B 9/20; A47B 91/022; A47B 91/024; A47B 91/026; A47B 91/10; B25H 1/16
See application file for complete search history.

(56) References Cited

U.S. PATENT DOCUMENTS

| | | | | | |
|---|---|---|---|---|---|
| 2,295,911 | A * | 9/1942 | Page | A47B 91/024 | 248/188.4 |
| 4,313,586 | A * | 2/1982 | Grzesnikowski | A47B 91/024 | 248/188.4 |
| 5,881,979 | A * | 3/1999 | Rozier, Jr. | A47B 91/024 | 248/188.4 |
| 6,520,461 | B1 * | 2/2003 | Graham | A47B 91/024 | 248/188.4 |
| 11,122,887 | B1 * | 9/2021 | Haupt | B60B 19/14 | |
| 2008/0191111 | A1 * | 8/2008 | Selle | A47B 91/024 | 248/302 |
| 2017/0276288 | A1 * | 9/2017 | Ramsauer | A47B 91/10 | |
| 2019/0387881 | A1 * | 12/2019 | Lin | F16B 43/02 | |
| 2020/0216104 | A1 * | 7/2020 | Leblanc | B62B 3/02 | |
| 2021/0289937 | A1 * | 9/2021 | Scharfenkamp | A47B 9/20 | |
| 2022/0225768 | A1 * | 7/2022 | Newman | A47B 91/12 | |
| 2023/0255351 | A1 * | 8/2023 | Kerl | A47B 91/024 | 248/188.4 |

* cited by examiner

*Primary Examiner* — Daniel J Rohrhoff
(74) *Attorney, Agent, or Firm* — Warner Norcross + Judd LLP

(57) ABSTRACT

An adjustable, leveling foot assembly and an adjustable workbench includes the foot assembly are provided. The workbench includes a bench top and a plurality of legs extending away from the bench top. Each leg includes an outer sidewall extending along a length of the leg and a terminal, outer end. The leveling assembly is disposed at the terminal end of each leg. Each leveling assembly includes a receiver mounted within the terminal end of one of the legs. A foot is engaged with the receiver and moveable relative to the receiver. An end cap including a bore is mounted on the terminal end of the said one of the legs. The foot is inserted through the bore. The end cap includes a first outer sidewall portion that is flush with the outer sidewall of the said one of the legs to provide a smooth, continuous transition.

14 Claims, 10 Drawing Sheets

WORKBENCH WITH ADJUSTABLE FOOT ASSEMBLY

FIELD OF THE INVENTION

The disclosure generally relates to furniture and, more specifically, to workbenches with adjustable feet.

BACKGROUND OF THE INVENTION

Some furniture, particularly those with a working support surface such as a table, chair, workbench, or desk, include adjustable feet and that end of the support legs. Adjustable feet allow a user to level the support legs of a piece of furniture on uneven and/or angled surfaces. However, conventional adjustable feet can be unsightly and are not particularly suited for legs of various cross-sectional shapes.

BRIEF SUMMARY

An improved adjustable foot assembly for a workbench having a leg is provided. The adjustable foot assembly includes a receiver, and a moveable engagement member that cooperates with the receiver. The disposition of the engagement member relative to the receiver is adjustable. The assembly further includes an end cap including a bore, and the engagement member is inserted through the bore. The end cap is mountable on a terminal end of the leg. The end cap has a first outer sidewall that is flush with an outer sidewall of the leg in a mounted disposition in which the end cap is mounted on the terminal end of the leg.

In specific embodiments, the end cap has a bottom surface, and the bore is formed through the bottom surface. The engagement member includes an outer surface that is flush with the bottom surface of the end cap in a fully retracted disposition in which the engagement member cannot move further into the bore.

In specific embodiments, the first outer sidewall of the end cap has the same cross-sectional shape as the outer sidewall of the leg.

In specific embodiments, the end cap includes a second outer sidewall that is adjacent the first outer sidewall, and the second outer sidewall has a smaller perimeter than the first outer sidewall.

In specific embodiments, the second outer sidewall is receivable in the terminal end of the leg.

In specific embodiments, the receiver includes a threaded bore cooperable with threads on the engagement member.

An improved adjustable workbench is also provided. The adjustable workbench includes a bench top and a plurality of legs extending away from the bench top. Each leg includes an outer sidewall extending along a length of the leg and a terminal, outer end. A leveling assembly is disposed at the terminal end of each leg. Each leveling assembly includes a receiver mounted within the terminal end of one of the legs. A foot is engaged with the receiver and moveable relative to the receiver. An end cap including a bore is mounted on the terminal end of the said one of the legs. The foot is inserted through the bore. The end cap includes a first outer sidewall portion that is flush with the outer sidewall of the said one of the legs.

In specific embodiments, the end cap has a bottom surface, and the bore is formed through the bottom surface. The foot includes an outer surface that is flush with the bottom surface of the end cap in a fully retracted disposition in which the foot cannot move further into the bore.

In specific embodiments, the first outer sidewall portion of the end cap has a same cross-sectional shape as the outer sidewall of said one of the legs.

In specific embodiments, the end cap includes a second outer sidewall portion spaced from the first outer sidewall portion by a shoulder. The second outer sidewall portion has a smaller perimeter than the first outer sidewall portion, and the second outer sidewall portion is received in the terminal end of said one of the legs.

In specific embodiments, the foot includes a base and a stem extending from the base.

In particular embodiments, the stem is a threaded rod, and the receiver includes a threaded aperture cooperable with the threaded rod.

In specific embodiments, the legs are telescoping legs, and each telescoping leg includes an outer member and an inner member that telescopes relative to the outer member to extend and retract the telescoping leg.

In particular embodiments, the end cap is mounted on the inner member of the telescoping leg.

In other embodiments, the adjustable workbench includes a frame and a bench top including an upper working surface and an opposite lower surface. The lower surface of the bench top is mounted on the frame. A plurality of legs are mounted on the frame and extend away from the lower surface of the bench top. Each leg includes an outer sidewall extending along a length of the leg and a terminal, outer end opposite the lower surface of the bench top. The outer end of each leg includes an opening. A receiver is mounted within the outer end of each leg proximate the opening. An end cap covers each opening of the legs. Each end cap includes a body. The body includes a bottom surface, a through-bore formed in the bottom surface and extending through the body from the bottom surface to an opposite end of the body, and an outer sidewall having a first sidewall portion and a second sidewall portion. A foot is inserted in the through-bore of each end cap. Each foot mates with a respective one of the receivers. The second sidewall portion of the body of each end cap is received in the opening in a respective one of the legs, and the first sidewall portion of the body of each end cap is flush with the outer sidewall of the respective one of the legs.

In specific embodiments, the first sidewall portion of the end caps has a same cross-sectional shape as the outer sidewall of the legs, and the first sidewall portion of the end caps has a perimeter that is equal to a perimeter of the outer sidewall of the legs.

In specific embodiments, each foot includes a base and a stem extending from the base, and the base includes an outer contact surface.

In particular embodiments, the outer contact surface of the base of the foot is flush with the bottom surface of the end cap in a fully retracted disposition in which the foot cannot move further into the bore.

In particular embodiments, the stem of the foot is a threaded rod. The receiver includes a bracket mounted to an inner wall of the leg and a threaded aperture on the bracket. The threaded aperture is cooperable with the threaded rod.

In specific embodiments, the legs are telescoping legs, and each telescoping leg includes an outer member and an inner member that telescopes relative to the outer member to extend and retract the telescoping leg. Each end cap is mounted on the inner member of a respective one of the telescoping legs.

DESCRIPTION OF THE DRAWINGS

Various advantages and aspects of this disclosure may be understood in view of the following detailed description when considered in connection with the accompanying drawings, wherein.

DETAILED DESCRIPTION OF THE INVENTION

Figure 1:
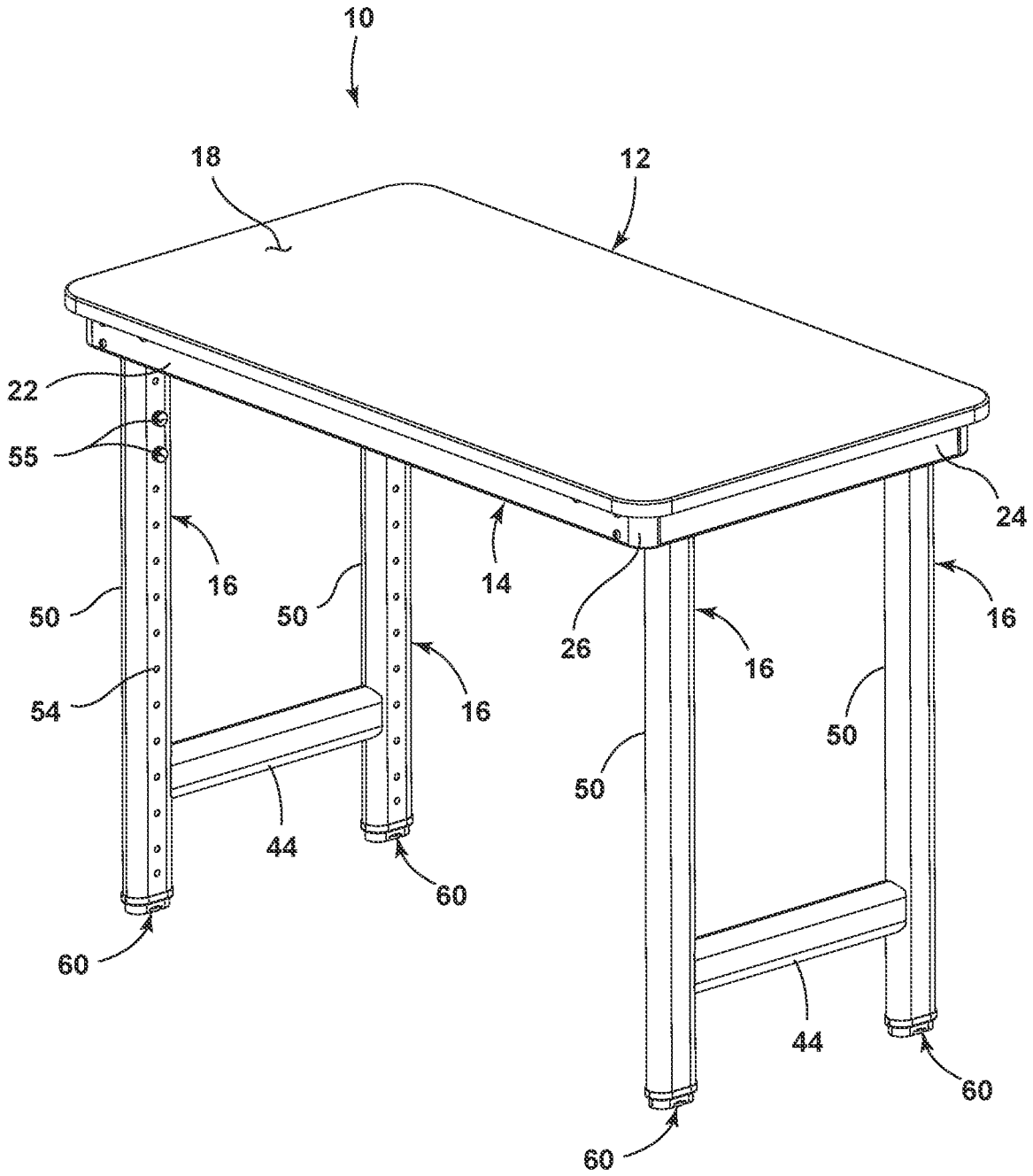
FIG. 1 is a perspective view of an adjustable workbench in accordance with embodiments of the disclosure.
Figure 2:
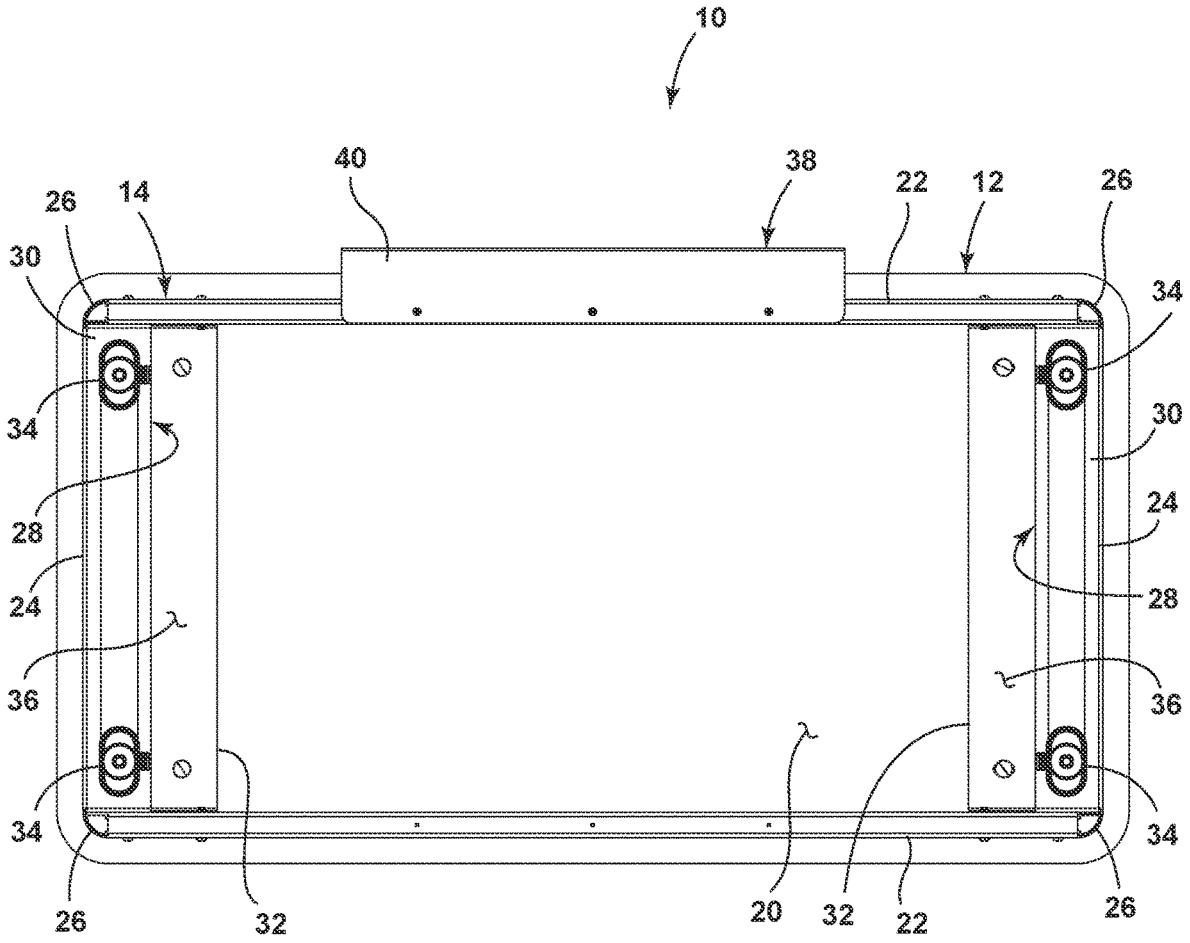
FIG. 2 is a bottom view of the adjustable workbench.

An adjustable foot assembly for a workbench and an adjustable workbench including the adjustable foot assembly are provided. Referring to FIGS. 1-10, wherein like numerals indicate corresponding parts throughout the several views, the adjustable workbench (also referred to as simply the workbench) is illustrated and generally designated at 10, and the adjustable foot assembly (also referred to as the foot assembly herein) is illustrated and generally designated at 60. The workbench 10 includes a bench top 12, a frame 14, a plurality of legs 16, and an equal number of the foot assemblies 60 associated with the legs 16. In one aspect of the disclosure, the workbench 10 has a stepless, seamless transition between the legs 16 and foot assemblies 60. In another aspect, the legs 16 and associated foot assemblies 60 provide for adjustment of the height of the workbench as well as for leveling of the workbench on all types and contours of floor surfaces. The construction of the workbench 10 and foot assembly 60 is described in greater detail below.

Turning first to FIGS. 1-4, the bench top 12 of the workbench 10 has an upper working surface 18 and an opposite lower surface 20. In an upright, use disposition of the workbench 10, the upper working surface 18 faces upwards and provides a generally flat surface on which objects may be set and/or on which tasks may be performed. The lower surface 20 faces a support surface on which the workbench stands, such as the ground, a floor, and the like. The bench top 12 is typically rectangular or square, but is not limited to a particular shape, and optionally may be an alternative shape such as a circular or hexagonal shape. The bench top 12 is also not particularly limited in material of construction and may be made, for example, of wood, metal, a polymer material, or a composite material.

The lower surface 20 of the bench top 12 is mounted on the frame 14. The frame 14 is capable of supporting the bench top 12 as well as the legs 16. The frame may be made, for example, of metal, but is not limited to metal, and may include plastic or composite components. In some embodiments, the frame 14 includes a pair of longitudinal, generally parallel side rails 22, and a pair of transverse, generally parallel end rails 24 disposed at the longitudinal ends of the side rails 22. A corner cap 26 is disposed at each of the four corners of the frame 14 at which a longitudinal end of one of the side rails 22 meets a longitudinal end of one of the end rails 24. For example, each corner cap 26 may be partially insertable into a longitudinal end of the side rail 22, and fasteners such as screws, bolts, or similar may fasten the corner caps 26 to the side rails 22. Each corner cap 26 has a rounded/curved outer surface to smoothly transition between the side rails 22 and the end rails 24. Each corner cap 26 also has an inner portion that is connected to the curved outer surface and that fits within the side rail 22 and against the end rail 24 so that the inner portion is not visible when the corner cap 26 is mounted in the side rail 22. The fasteners that secure the corner cap 26 in place mate with the inner portion of the corner cap. Also, the corner caps 26 may be color-matched to the side rails 22 and end rails 24 such that the outer surfaces of the side rails 22 and end rails 24 smoothly blend with the curved outer surface of the corner caps 26. The frame 14 further includes leg mounts 28. The leg mounts may be separate members, but in some embodiments as shown in the drawings, the leg mounts 26 are integral with the end rails 24. Particularly, each leg mount 26 includes a pair of flanges (top flange 30 and bottom flange 32) spaced from each other and extending inwardly relative to the outer surface of the end rail 24. One of the flanges 32 includes at least one, optionally two, openings 34 that are sized to match the cross-sectional dimensions of the legs 16. The other flange 30 includes an abutment surface 36 against which ends the legs 16 engage in a mounted disposition in which the legs are received and held in the leg mounts 28. Incidentally, in some embodiments, the bench top 12 is mounted to the frame 14 via fasteners (screws, bolts, or similar) the extend through apertures formed in the flange 30, and the bench top 12 may rest against a surface of the flange 30 that is opposite the abutment surface 36. It should be understood, however, that the leg mounts 28 are not limited to the embodiments shown in the drawings, and other means of connecting the legs to the frame are within the scope of the disclosure. Further, the bench top 12 may be mounted to any adjacent portion of the frame 14, and is not limited to being mounted to a flange that extends inwardly from the end rail 24.

Optionally, one or more accessory rails 38 may be mounted to the frame 14, such as to one of the side rails 22 of the frame 14. Each accessory rail 38 is an elongated member extending longitudinally along a portion of the side rail 22 and generally includes a base 40 and a sidewall 42. The base 40 extends transversely from the side rail 22 a distance much shorter (e.g., a few inches) than the length of the base 40. The sidewall 42 may be disposed at approximately a right angle relative to the base 40, and the sidewall 42 may extend upwardly a distance such that it does not extend vertically above the working surface 18 of the bench top 12. The accessory rail 38 may be used, for example, to hold and manage electrical power cords of electrically powered devices that are placed on the working surface 18 of the bench top 12 and/or that are used to perform work at or on the bench top.

Figure 3:
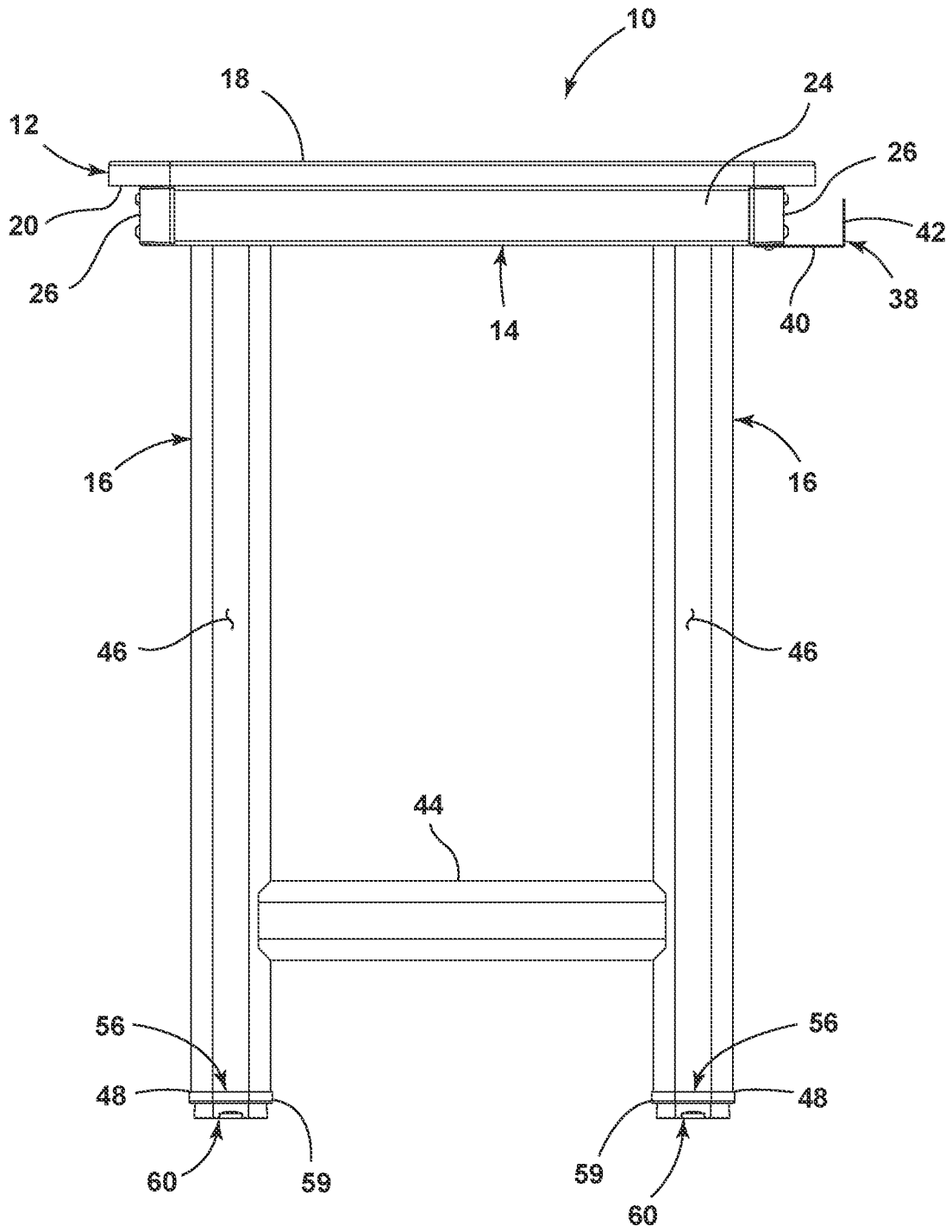
FIG. 3 is a side view of the adjustable workbench.
Figure 4:
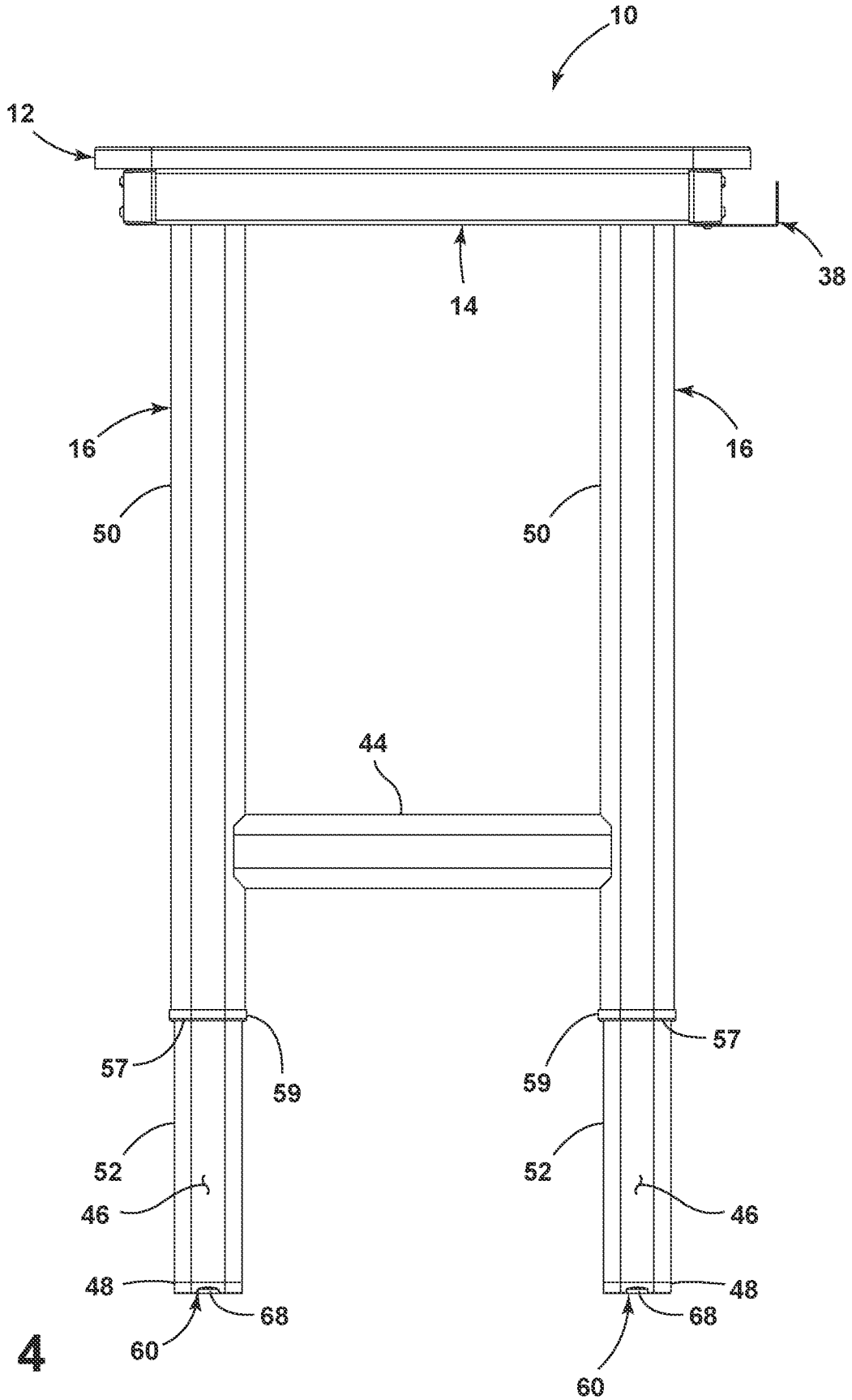
FIG. 4 is a side view of the adjustable workbench, illustrating extension of the legs of the workbench.
Figure 5:
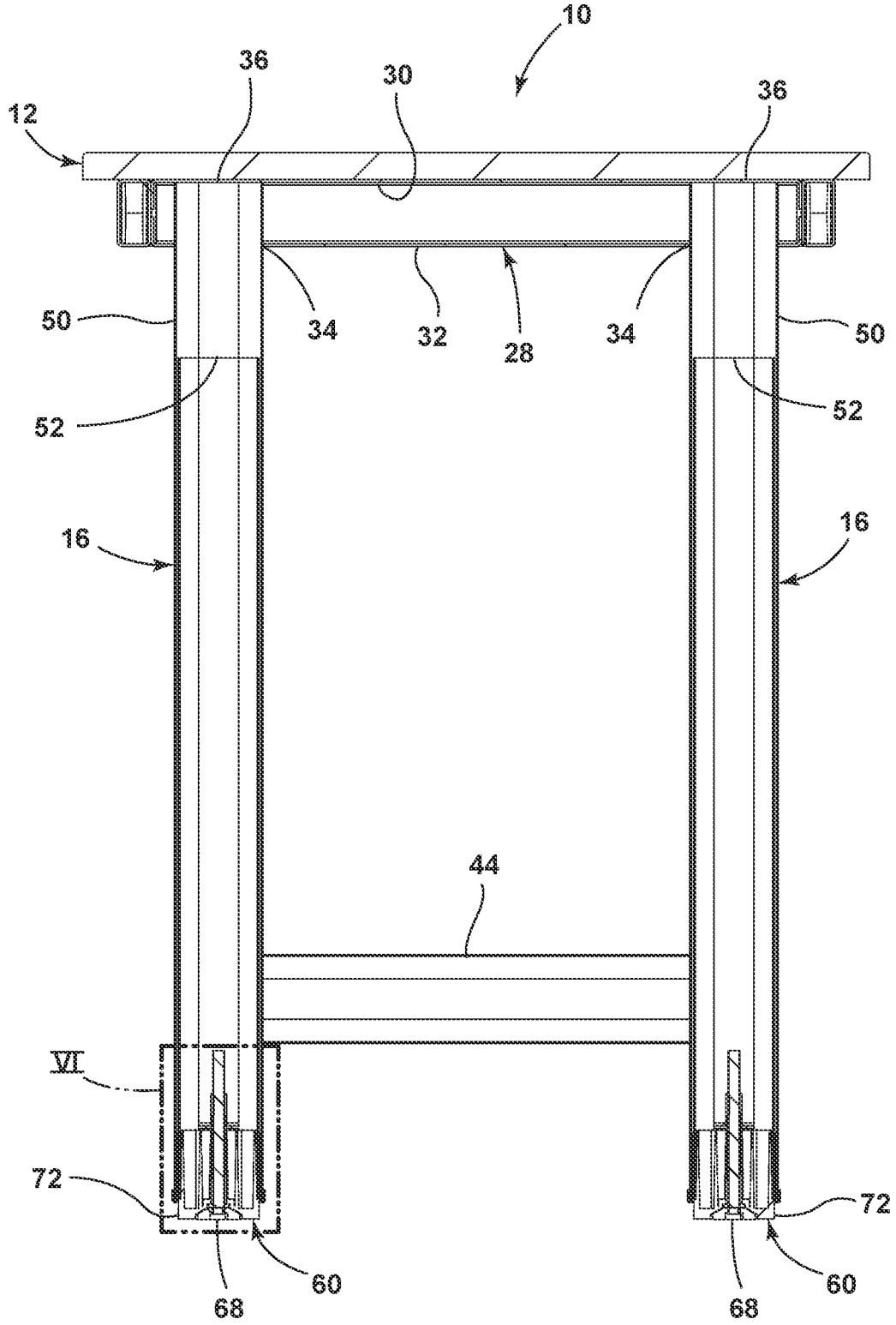
FIG. 5 is a cross-sectional view of a pair of legs of the workbench, showing foot assemblies of the workbench in greater detail.
Figure 6:
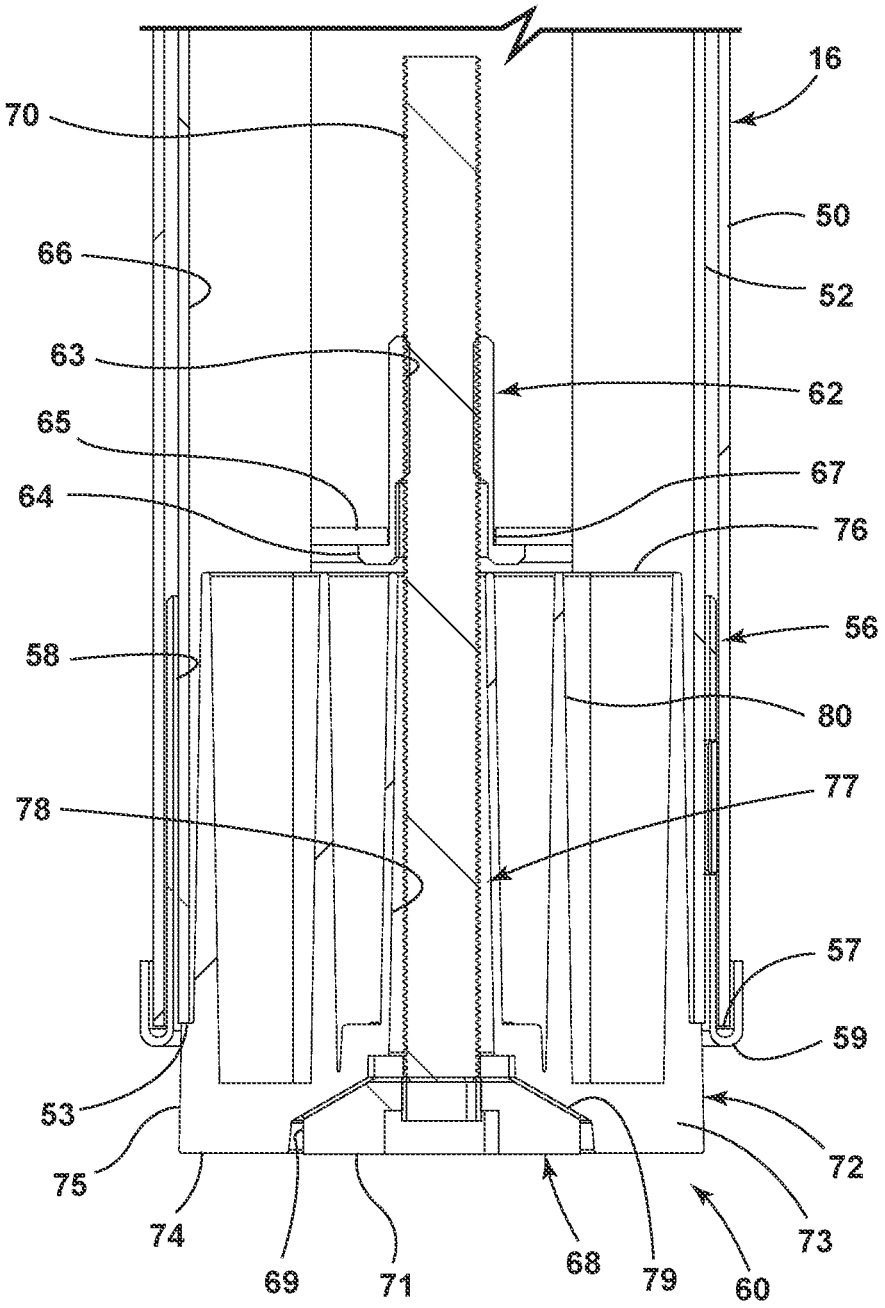
FIG. 6 is an enlarged view of a terminal end portion of one leg taken from box VI in FIG. 5.
Figure 7:
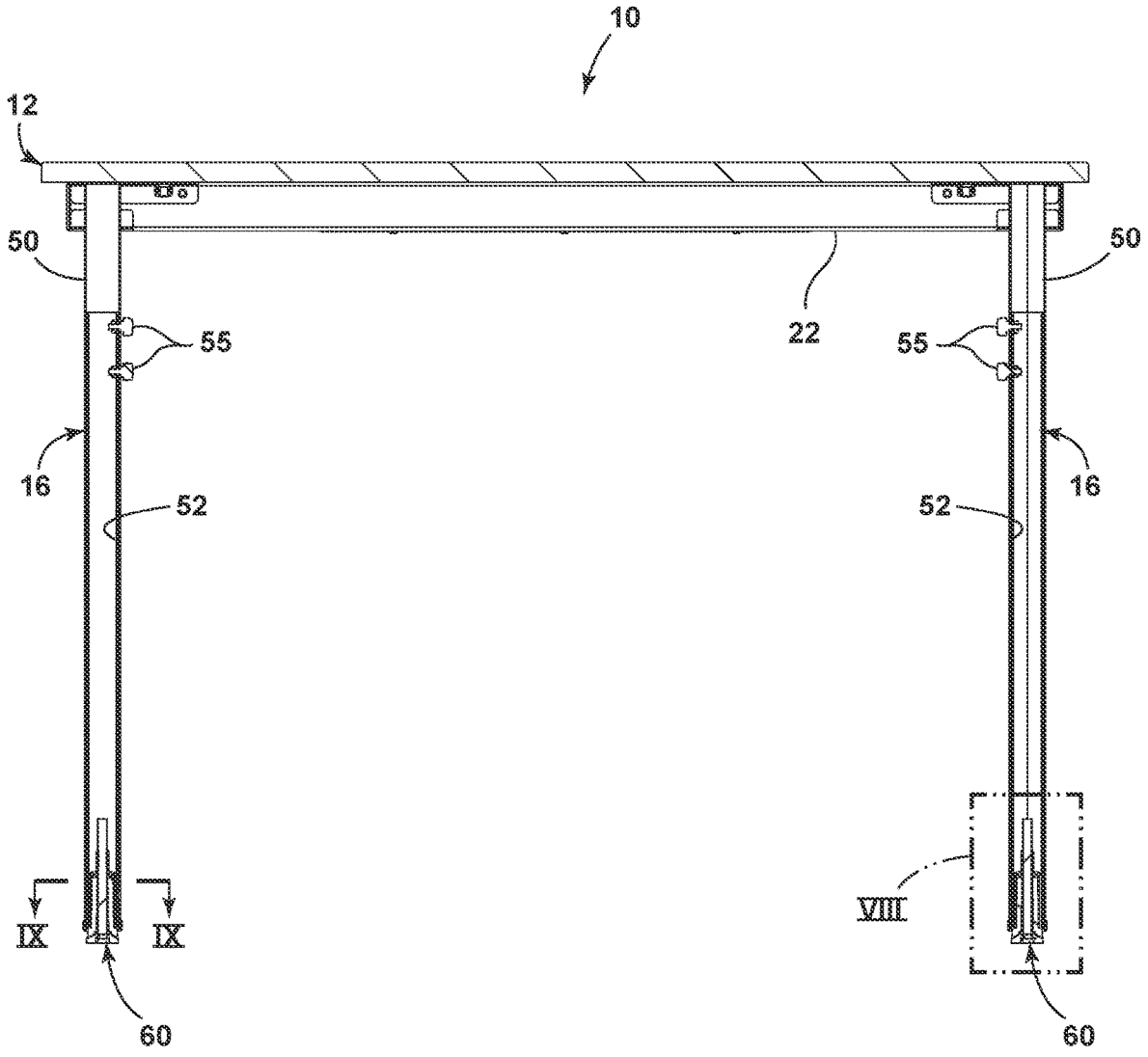
FIG. 7 is a cross-sectional view of the adjustable workbench.

Each of the legs 16 extends away from the lower surface 20 of the bench top 12 and downwardly from the frame 14 (in the upright disposition of the workbench 10). In some embodiments such as that shown in the drawings, the two legs 16 at each end of the workbench 10 may be joined together with a crossbar 44 such that the workbench 10 includes two separate leg assemblies that each include two of the workbench legs 16. The crossbars 44 provide strength and rigidity/stability to the legs 16. Each leg 16 has an outer sidewall 46 that extends along the length of the leg 16 from an inner end at the frame 14 to a terminal, outer end 48 that is opposite the lower surface 20 of the bench top 12. The outer sidewall 46 optionally may have an oval or oval-like shape or a rectangular shape with curved, semi-circular ends (i.e., a stadium shape), but may have other shapes such as a circular shape. As shown in FIGS. 3 and 4, in some embodiments each leg 16 is preferably a telescoping leg that is expandable and retractable to vary the length of the leg. For example, each telescoping leg 16 includes an outer member 50 and an inner member 52 that fits into the outer member 50 and that telescopes relative to the outer member to extend and retract the telescoping leg 16. Indexing apertures 54 may be formed in the outer sidewall 46 of the outer member 50, and fasteners 55 such as screws, bolts, or similar extend through the indexing apertures 54 and forcibly contact the inner member 52 to secure the inner member to the outer member 50. Alternatively, indexing apertures may be formed in the outer sidewalls of both the outer and inner members, and fasteners such as screws, bolts, or similar extend through aligned indexing apertures in the outer and inner members to secure the inner member to the outer member. A spacer 56 may be disposed within an outer end 57 of the outer member 50 between the outer member and the inner member 52. The spacer 56 fills the gap between the outer and inner members 50, 52 and provides a guide surface 58 along which the inner member 52 slides as the inner members is extended and retracted. The spacer 56 may also include a decorative rim 59 that extends around the perimeter of the outer member 50 at its outer end 57.

With reference now to FIGS. 5-10, the outer, terminal end 48 of each leg 16 (in the case of telescoping legs, the outer, terminal end 48 being the outer end of the inner telescoping member 52) includes an opening 53 having a cross-sectional shape that generally matches the cross-sectional shape of the leg 16. One of the adjustable foot assemblies 60 is disposed at the outer end 48 of each leg 16. Each adjustable foot assembly 60 includes a receiver 62 that is mounted within the outer end 48 of the leg 16 proximate the opening 53. In some embodiments, the receiver 62 is a nut or similar member including a threaded aperture or bore. For example, as shown in the drawings, the receiver 62 may be a tubular member having a threaded through-bore 63 and an external, annular flange 64. The annular flange engages a bracket 65 that is connected to the inner wall 66 of the inner telescoping member 52 of the leg 16. The bracket 65 has a circular opening 67 through which the receiver 62 is inserted, and the annular flange 64 engages the bracket 65 around the perimeter of the circular opening 67. The adjustable foot assembly 60 further includes a moveable engagement member shown in the form of a foot 68 that is mated with the receiver 62 and whose disposition relative to the receiver is adjustable. The foot 68 includes a base 69 and a stem 70 that extends normal to the base 69. The stem 70 is a threaded rod that cooperates with the threads of the threaded through-bore 63 of the receiver 62. Rotational movement of the stem 70 relative to the receiver 62 causes the stem 70 to move axially relative to the receiver 62, and in turn moves the base 69 of the foot 68 inwardly and outwardly relative to the opening 53 in the inner telescoping member 52 of the leg 16. The base 69 of the foot 68 has an outer contact surface 71 that is adapted for contact with a support surface for the workbench 10 such as the ground, a floor, or the like. The base 69 may be a circular and/or annular member that is fixed to the end of the stem 70.

The adjustable foot assembly 60 further includes an end cap 72. The end cap may be formed of a monolithic body 73, which may be composed of, for example, a polymeric or rubber material. The body has a bottom surface 74, an outer sidewall 75 extending from the bottom surface 74 to an end 76 that is opposite the bottom surface 74. A through-bore 77 is formed in the bottom surface 74 and extends through the body 73 from the bottom surface 74 to the opposite end 76. The through-bore 77 includes a stem-receiving portion 78 and an adjacent, tapered base-receiving portion 79. The body 73 is generally hollow between the through-bore 77 and sidewall 75 with the exception of a plurality of support ribs 80. However, the body alternatively may be generally solid between the through-bore and the outer sidewall. The outer sidewall 75 has two portions: a first sidewall portion 81 and a second sidewall portion 82 spaced and separated from the first sidewall portion 81 by a shoulder 83. The outer sidewall 75 has the same cross-sectional shape as the outer sidewall 46 of the leg 16. Further, the cross-section of the second sidewall portion 82 of the body outer sidewall 75 is sized to be the same as or similar to the inner perimeter of the inner wall 66 of the inner telescoping member 52 of the leg 16, such that the body 73 can snuggly fit within the inner leg member 52. In some embodiments and as shown in detail in FIG. 9, the cross-section of the second sidewall portion 82 is similar to that of the inside of the inner telescoping member 52, the length of the body 53 at the second sidewall portion 82 is the same as the length across the inside of the inner telescoping member 52, but the width of the body 53 at the second sidewall portion 82 is less than the width across the inside of the inner telescoping member 52 such that the second sidewall portion 82 fits snugly between the bracket 65 that is disposed within the inner telescoping member 52. The cross-section of the first sidewall portion 81 of the body outer sidewall 75 is sized to be the same as the outer sidewall 46 of the inner telescoping member 52 of the leg 16. In other words, the perimeter of the first sidewall portion 81 is the same shape and equal length as the perimeter of the outer sidewall 46 of the inner telescoping member 52. As such, the second sidewall portion 82 has a smaller perimeter than the first sidewall portion 81, and the second sidewall portion 82 is received within the opening 53 of the inner telescoping member 52 of the leg 16 to mount the end cap 72 on the terminal end 48 of the leg 16. When the end cap 72 is mounted on the terminal end 48 of the leg 16, the shoulder 83 abuts against the terminal end 48 of the leg 16, and the first sidewall portion 81 is flush with the outer sidewall 46 of the inner telescoping member 52 of the leg 16. Thus, the outer sidewall 46 of the portion (terminal end) of the leg 16 that mates with the end cap 72 matches the first sidewall portion 81 of the end cap body 73 so that there is a smooth and continuous transition from the leg 16 (in this case, the inner telescoping member 52 of the leg 16) to the end cap 72. In this mounted disposition, the end cap 72 also covers the opening 53 in the inner telescoping member 52.

The stem 70 of the foot 68 is inserted through the through-bore 77 of the end cap 72 to mate the foot 68 with the receiver 62. In a fully retracted disposition in which the foot 68 is retracted as far as possible into the end cap 72 and inner telescoping member 52 of the leg 16, the base 69 of the foot 68 rests against the tapered base-receiving portion 79 of the through-bore 77 and the foot 68 cannot mover further into the through-bore 77. Also, in the fully retracted disposition, the outer contact surface 71 of the base 69 of the foot 68 is flush with the bottom surface 74 of the end cap body 73.

Figure 8:
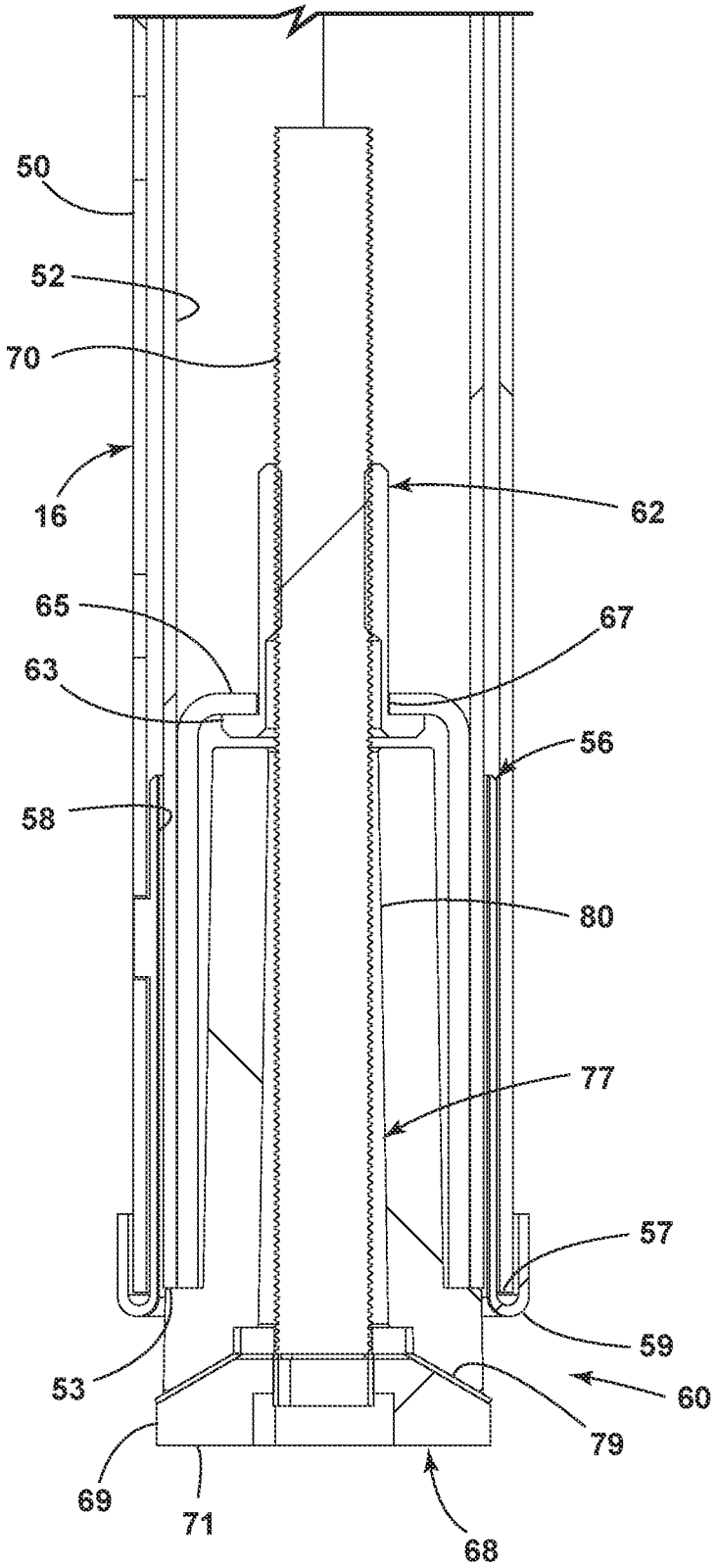
FIG. 8 is an enlarged view of a terminal end portion of one leg taken from box VIII in FIG. 7.
Figure 9:
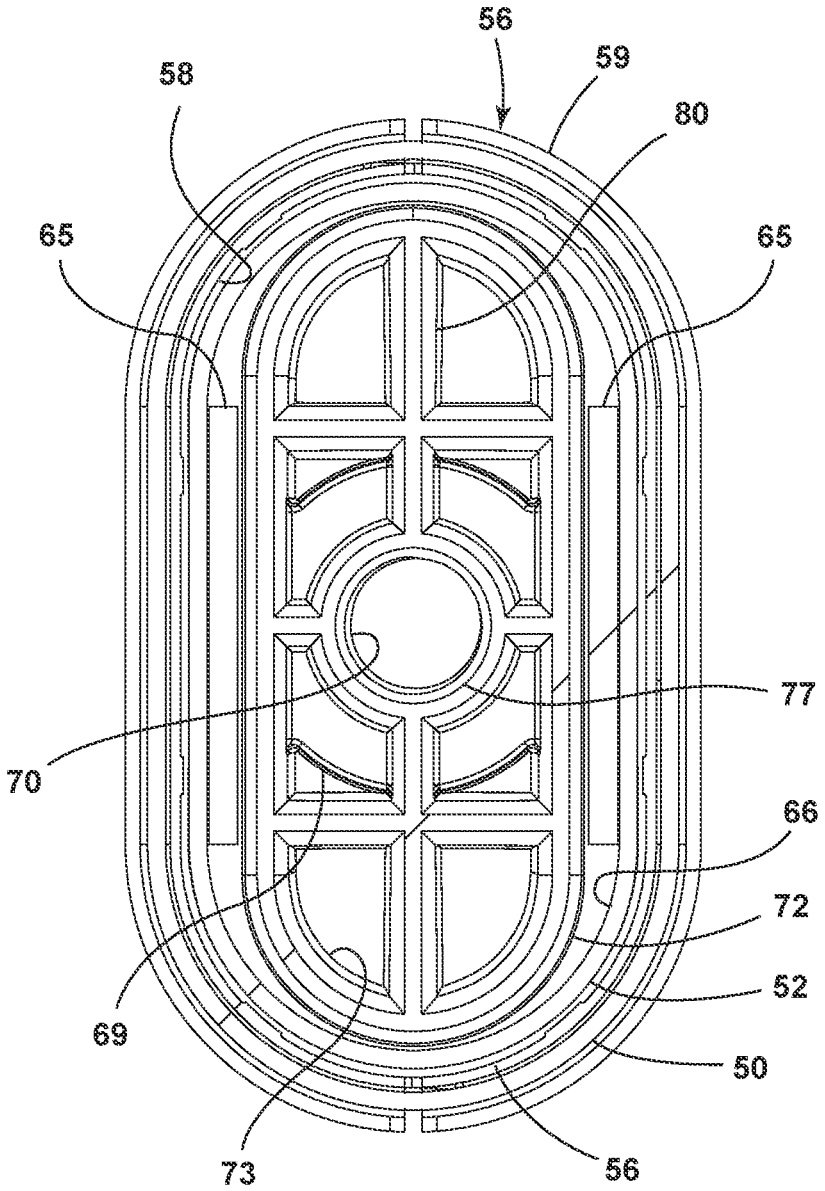
FIG. 9 is a cross-sectional view of the terminal end portion taken along the line IX-IX in FIG. 7.
Figure 10:
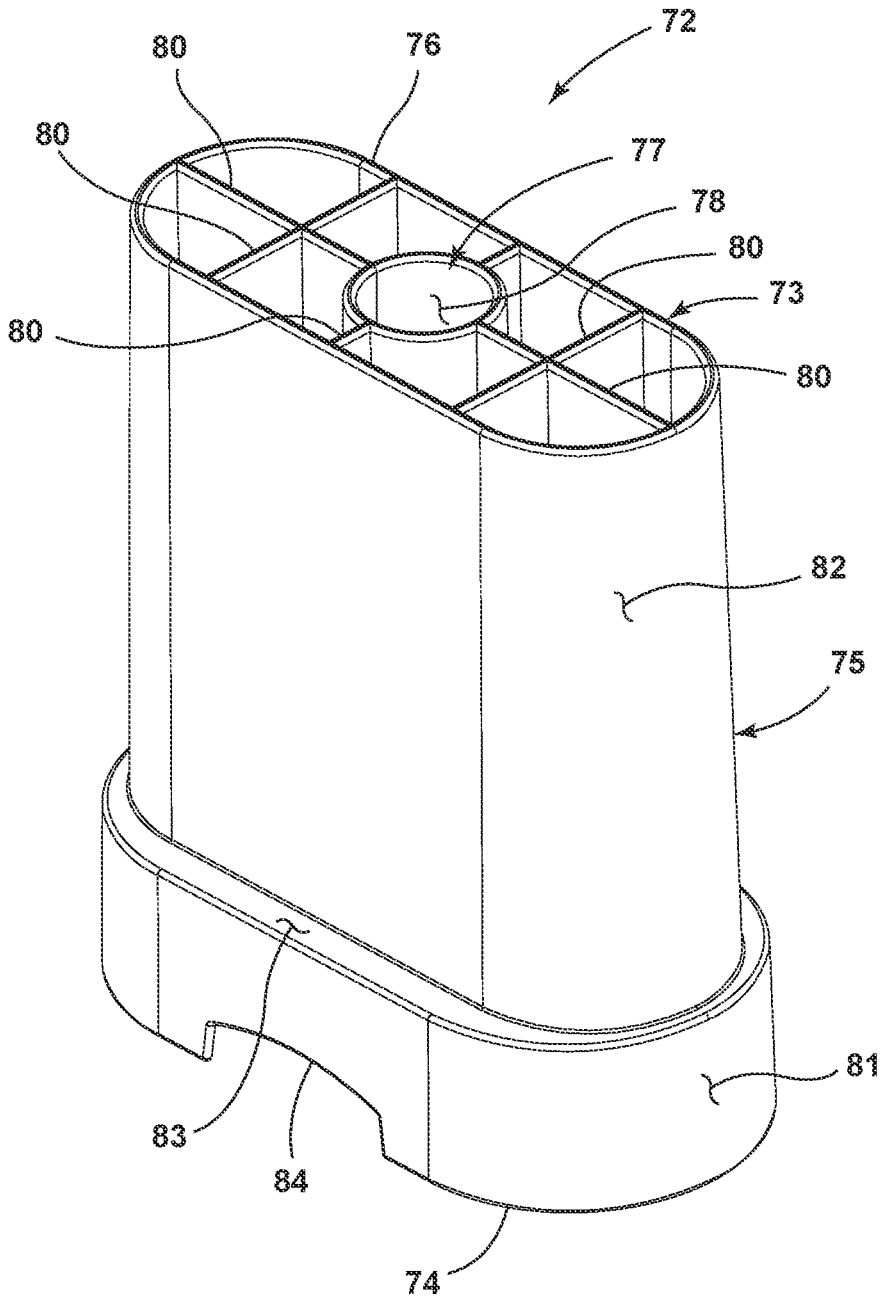
FIG. 10 is a perspective view of an end cap of the foot assembly.

The foot assembly 60 defines a leveling assembly for leveling the workbench 10 on the ground, a floor, or other support surfaces which may be uneven. As noted above, in the fully retracted disposition, the foot 68 is fully retracted into the end cap 72. The end cap further includes a cut-out indentation 84 along each of the two longitudinal sides of the first outer sidewall portion 81 and adjacent to the bottom surface 74 of the body 73. As best seen in FIG. 8, a small portion of the base 69 of the foot 68 extends through the cut-out indentation 84 on each of the two longitudinal sides. The cut-out indentations 84 and extension of the base 69 therethrough allows a user to grip the base when the foot 68 is fully retracted, so that the user can rotate the base 69 to cause the foot 68 to extend outwardly from the end cap 72 thereby moving the base 69 out of and away from the end cap 72. Extension of the foot 68 effectively increases the length of the associated leg 16, and as such rotational movement of the foot 68 adjusts the length of the leg in order to level the workbench, i.e. so that the bench top 12 is level and does not rock from side to side (leg to leg) when downward forces are exerted and/or removed from the bench top.

It is to be understood that the appended claims are not limited to express and particular compounds, compositions, or methods described in the detailed description, which may vary between particular embodiments which fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

Further, any ranges and subranges relied upon in describing various embodiments of the present invention independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present invention, and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims, and may be relied upon individually and/or collectively and provide adequate support for specific embodiments within the scope of the appended claims. In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange of from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

What is claimed is:

1. An adjustable foot assembly for a workbench having a leg, the assembly comprising:

a receiver that is a tubular member including a threaded bore and an external, annular flange extending outwardly from the tubular member;

a moveable engagement member including a base and a threaded rod extending from the base, the threaded rod cooperating with the threaded bore of the receiver, the disposition of the engagement member relative to the receiver being adjustable;

a bracket including a circular opening through which the receiver is inserted, the annular flange of the receiver engaging an inner wall of the bracket around a perimeter of the circular opening and the tubular member extending outwardly from the circular opening of the bracket;

an end cap formed of a monolithic body, the monolithic body a bottom surface and an outer sidewall extending from the bottom surface to an opposite end, and including a bore extending through the body from the bottom surface to the opposite end, the bore including a stem-receiving portion and an adjacent, tapered base-receiving portion that is wider than the stem-receiving portion, wherein the outer sidewall of the monolithic body includes a first outer sidewall portion and a second outer sidewall portion adjacent the first outer sidewall portion, the second outer sidewall portion having a smaller perimeter than the first outer sidewall portion, and the second outer sidewall portion being separated from the first outer sidewall portion by a shoulder;

the engagement member being inserted through the stem-receiving portion of the bore of the end cap, wherein the base of the engagement member is receivable in the tapered base-receiving portion;

the end cap being mountable on a terminal end of the leg via the bracket, wherein the second outer sidewall portion is inserted between the bracket, the bracket is connected to an inner wall of the leg, and the first outer sidewall portion of the end cap is flush with an outer sidewall of the leg in a mounted disposition in which the end cap is mounted on the terminal end of the leg.

2. The assembly of claim 1, wherein the bore of the end cap is formed through the bottom surface, and the engagement member including an outer surface that is flush with the bottom surface of the end cap in a fully retracted disposition in which the engagement member cannot move further into the bore.

3. The assembly of claim 1, wherein the first outer sidewall of the end cap has the same cross-sectional shape as the outer sidewall of the leg.

4. The assembly of claim 1, wherein the second outer sidewall is receivable in the terminal end of the leg.

5. An adjustable workbench comprising:

a bench top;

a plurality of legs extending away from the bench top, each leg including an outer sidewall extending along a length of the leg, an inner wall, and a terminal, outer end; and a leveling assembly disposed at the terminal end of each leg;

each leveling assembly including:

a receiver mounted within the terminal end of one of the legs, the receiver being a tubular member including a threaded bore and an external, annular flange extending outwardly from the tubular member;

a foot including a base and a stem extending from the base, the stem including threads engaged with the threaded bore of the receiver, the foot being moveable relative to the receiver;

a bracket including a circular opening through which the receiver is inserted, the annular flange of the receiver engaging an inner wall of the bracket around a perimeter of the circular opening and the tubular member extending outwardly from the circular opening of the bracket; and an end cap formed of a monolithic body, the monolithic body including a bottom surface and an outer sidewall extending from the bottom surface to an opposite end, and a bore extending through the body from the bottom surface to the opposite end, the bore including a stem-receiving portion and an adjacent, tapered base-receiving portion that is wider than the stem-receiving portion, wherein the outer sidewall of the monolithic body includes a first outer sidewall portion and a second outer sidewall portion adjacent the first outer sidewall portion, the second outer sidewall portion having a smaller perimeter than the first outer sidewall portion, and the second outer sidewall portion being separated from the first outer sidewall portion by a shoulder, the foot being inserted through the stem-receiving portion of the bore of the end cap, wherein the base of the foot is receivable in the tapered base-receiving portion;

wherein the end cap is mounted on the terminal end of said one of the legs via the bracket, the second outer sidewall portion is inserted between the bracket, the bracket is connected to the inner wall of the leg and the second outer sidewall portion is received in the terminal end of the said one of the legs, and the first outer sidewall portion of the end cap is flush with the outer sidewall of the said one of the legs.

6. The adjustable workbench of claim 5, wherein the bore of the end cap is formed through the bottom surface, and the foot includes an outer surface that is flush with the bottom surface of the end cap in a fully retracted disposition in which the foot cannot move further into the bore.

7. The adjustable workbench of claim 5, wherein the first outer sidewall portion of the end cap has a same cross-sectional shape as the outer sidewall of said one of the legs.

8. The adjustable workbench of claim 5, wherein the legs are telescoping legs, each telescoping leg including an outer member and an inner member that telescopes relative to the outer member to extend and retract the telescoping leg.

9. The adjustable workbench of claim 8, wherein the end cap is mounted on the inner member of the telescoping leg.

10. An adjustable workbench comprising:

a bench top including an upper working surface and an opposite lower surface;

a frame;

the lower surface of the bench top being mounted on the frame;

a plurality of legs mounted on the frame and extending away from the lower surface of the bench top, each leg including an outer sidewall extending along a length of the leg, an inner wall, and a terminal, outer end opposite the lower surface of the bench top;

the outer end of each leg including an opening;

a receiver mounted within the outer end of each leg proximate the opening, the receiver being a tubular member including a threaded bore and an external, annular flange extending outwardly from the tubular member;

a bracket connected to the inner wall of each leg and including a circular opening through which the receiver is inserted, the annular flange of the receiver engaging an inner wall of the bracket around a perimeter of the circular opening and the tubular member extending outwardly from the circular opening of the bracket;

an end cap covering each opening of the legs, each end cap including a monolithic body, the monolithic body including a bottom surface, a through-bore formed in the bottom surface and extending through the body from the bottom surface to an opposite end of the body, and an outer sidewall extending from the bottom surface to the opposite end, the outer sidewall having a first sidewall portion and a second sidewall portion adjacent the first sidewall portion, the second outer sidewall portion having a smaller perimeter than the first outer sidewall portion, and the second outer sidewall portion being separated from the first outer sidewall portion by a shoulder, and the through-bore including a stem-receiving portion and an adjacent, tapered base-receiving portion that is wider than the stem-receiving portion;

a foot including a base and a stem extending from the base, the stem including threads engaged with the threaded bore of a respective one of the receivers and being moveable relative to the receiver, the foot being inserted in the through-bore of each end cap, the foot extending through the stem-receiving portion of the through-bore, the base of the foot being receivable in the tapered base-receiving portion of the through-bore;

wherein the second sidewall portion of the body of each end cap is received in the opening in a respective one of the legs, each end cap is mounted on the terminal end of the respective one of the legs via the bracket, the second outer sidewall portion is inserted between the bracket, and the first sidewall portion of the body of each end cap is flush with the outer sidewall of the respective one of the legs.

11. The adjustable workbench of claim 10, wherein the first sidewall portion of the end caps has a same cross-sectional shape as the outer sidewall of the legs, and the first sidewall portion of the end caps has a perimeter that is equal to a perimeter of the outer sidewall of the legs.

12. The adjustable workbench of claim 10, wherein the base of each foot includes an outer contact surface.

13. The adjustable workbench of claim 12, wherein the outer contact surface of the base of the foot is flush with the bottom surface of the end cap in a fully retracted disposition in which the foot cannot move further into the bore.

14. The adjustable workbench of claim 10, wherein the legs are telescoping legs, each telescoping leg including an outer member and an inner member that telescopes relative to the outer member to extend and retract the telescoping leg; and each end cap is mounted on the inner member of a respective one of the telescoping legs.

* * * * *